US011694865B2

(12) United States Patent
Chou

(10) Patent No.: US 11,694,865 B2
(45) Date of Patent: Jul. 4, 2023

(54) TILT BALL SWITCH

(71) Applicant: Tien-Ming Chou, Taichung City (TW)

(72) Inventor: Tien-Ming Chou, Taichung City (TW)

( * ) Notice: Subject to any disclaimer, the term of this patent is extended or adjusted under 35 U.S.C. 154(b) by 0 days.

(21) Appl. No.: 17/664,287

(22) Filed: May 20, 2022

(65) Prior Publication Data

US 2023/0027549 A1 Jan. 26, 2023

(30) Foreign Application Priority Data

Jul. 21, 2021 (TW) ..... 110126766

(51) Int. Cl.
*H01H 35/02* (2006.01)

(52) U.S. Cl.
CPC ..... *H01H 35/02* (2013.01); *H01H 2205/016* (2013.01)

(58) Field of Classification Search
CPC ..... H01H 21/22; H01H 21/04; H01H 35/02; H01H 11/04; H01H 35/025; H01H 35/14; H01H 35/141
USPC ..... 200/1 R, 52 R, 61.45 R-61.45 M, 329
See application file for complete search history.

(56) References Cited

U.S. PATENT DOCUMENTS 6,198,059 B1* 3/2001 Jou ..... H01H 35/025 200/61.52
7,230,193 B2* 6/2007 Chou ..... H01H 35/14 200/61.52

* cited by examiner

*Primary Examiner* — Edwin A. Leon
*Assistant Examiner* — Iman Malakooti
(74) *Attorney, Agent, or Firm* — Lewis Roca Rothgerber Christie LLP

(57) ABSTRACT

A tilt ball switch has a chamber space, and includes a first terminal, a second terminal including two outer terminal members and an inner terminal member, and a conductive ball movably disposed in the chamber space and convertible between a conducting state, in which the conductive ball is in contact with the first terminal and the inner terminal member so that the first terminal is conductively connected to the outer terminal members, and a non-conducting state, in which the conductive ball is prevented from being in contact with one of the first terminal and the inner terminal member so that the first terminal is prevented from being conductively connected to the outer terminal members.

7 Claims, 9 Drawing Sheets

TILT BALL SWITCH

CROSS-REFERENCE TO RELATED APPLICATION

This application claims priority to Taiwanese Invention Patent Application No. 110126766, filed on Jul. 21, 2021.

FIELD

The disclosure relates to a switch, and more particularly to a tilt ball switch.

BACKGROUND

Referring to FIG. 1, a conventional tilt ball switch 9 disclosed in Taiwanese Utility Model Patent No. 476445 includes a conductive shell body 91, a conductive block 92 and a ball 93. The conductive shell body 91 has an inner surface 911, an outer surface 912, an open end 913, a closed end 914, a protrusion 915, and a shell terminal portion 916. The inner surface 911 defines an accommodating chamber 94 that opens downwardly. The outer surface 912 is opposite to the inner surface 911. The open end 913 interconnects the inner surface 911 and the outer surface 912. The closed end 914 is opposite to the open end 913 in an up-down direction. The protrusion 915 is connected to the inner surface 911 and is adjacent to the closed end 914. The shell terminal portion 916 is connected to the outer surface 912 and is adjacent to the closed end 914. The conductive block 92 has a main body portion 921, a block terminal portion 922 and a conical surface 923. The main body portion 921 extends into the accommodating chamber 94 of the conductive shell body 91, and has a bottom end and a top end. The block terminal portion 922 is connected to the bottom end of the main body portion 922 and is adjacent to the open end 913 of the conductive shell body 91. The conical surface 923 extends downwardly from the top end of the main body portion, tapers toward the bottom end of the main body portion, and defines a groove 95 that opens upwardly. The ball 93 is disposed at the groove 95. When the conventional tilt ball switch 9 is not tilted, the ball 93 is only in contact with the conical surface 923, and the shell terminal portion 916 of the conductive shell body 91 and the block terminal portion 922 of the conductive block 92 are not conductively connected (i.e., the conventional tilt ball switch 9 is in an OFF state). When the conventional tilt ball switch 9 is tilted at a predetermined angle with respect to a reference horizontal plane (G), the ball 93 rolls toward the protrusion 915 along the conical surface 923 so as to be in contact with the protrusion 915. When the ball 93 is in contact with both the protrusion 915 and the conical surface 923, the shell terminal portion 916 of the conductive shell body 91 and the block terminal portion 922 of the conductive block 92 are conductively connected by the ball 93 (i.e., the conventional tilt ball switch 9 is in an ON state) .

However, when the conventional tilt ball switch 9 is tilted at an angle greater than the predetermined angle, the ball 93 remains at the same position. Therefore, the ball 93 is still in contact with both the protrusion 915 and the conical surface 923 (i.e., the shell terminal portion 916 and the block terminal portion 922 are still conductively connected). That is to say, the conventional tilt ball switch 9 is not able to serve as a switch that can be converted to the Off state when tilted at an angle greater than the predetermined angle. Furthermore, due to the structural arrangement of the protrusion 915 and the conical surface 923, the ball 93 may be easily stuck in the gap between the protrusion 915 and the conical surface 923.

SUMMARY

Therefore, an object of the disclosure is to provide a tilt ball switch that can alleviate at least one of the drawbacks of the prior art.

According to the disclosure, the tilt ball switch includes an insulation housing, a first terminal, a second terminal and a conductive ball. The insulation housing includes a lower housing wall, an upper housing wall and a top wall. The lower housing wall has a lower inner wall surface that surrounds an axis extending in an up-down direction, and a lower outer wall surface that surrounds the lower inner wall surface. The upper housing wall is located over the lower housing wall and has an upper inner wall surface that surrounds the axis, and an upper outer wall surface that surrounds the upper inner wall surface. The top wall is located over the upper housing wall. The axis extends through the top wall. The first terminal is disposed at the lower inner wall surface of the lower housing wall and has a platform surface and a frustoconical surface. The axis extends through the platform surface. The frustoconical surface surrounds the axis, extends upwardly from the platform surface, and cooperates with a base line that is orthogonal to the axis to define an inclination angle therebetween. The inclination angle ranges from 10 to 85 degrees. The frustoconical surface tapers toward the platform surface. The second terminal includes an inner terminal member, two outer terminal members and two conductive members. The inner terminal member surrounds the axis and is disposed at the upper inner surface of the upper housing wall. The outer terminal members are spaced apart from each other and are disposed at the upper outer surface of the upper housing wall. Each of the conductive members extends from the upper inner wall surface to the upper outer wall surface, and conductively interconnects the inner terminal member and a respective one of the outer terminal members. The lower housing wall cooperates with the upper housing wall, the top wall, the first terminal and the inner terminal member of the second terminal to define a chamber space. The conductive ball is movably disposed in the chamber space and is convertible between a conducting state, in which the conductive ball is in contact with the frustoconical surface of the first terminal and the inner terminal member of the second terminal so that the first terminal is conductively connected to the outer terminal members of the second terminal, and a non-conducting state, in which the conductive ball is prevented from being in contact with one of the frustoconical surface of the first terminal and the inner terminal member so that the first terminal is prevented from being conductively connected to the outer terminal members.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
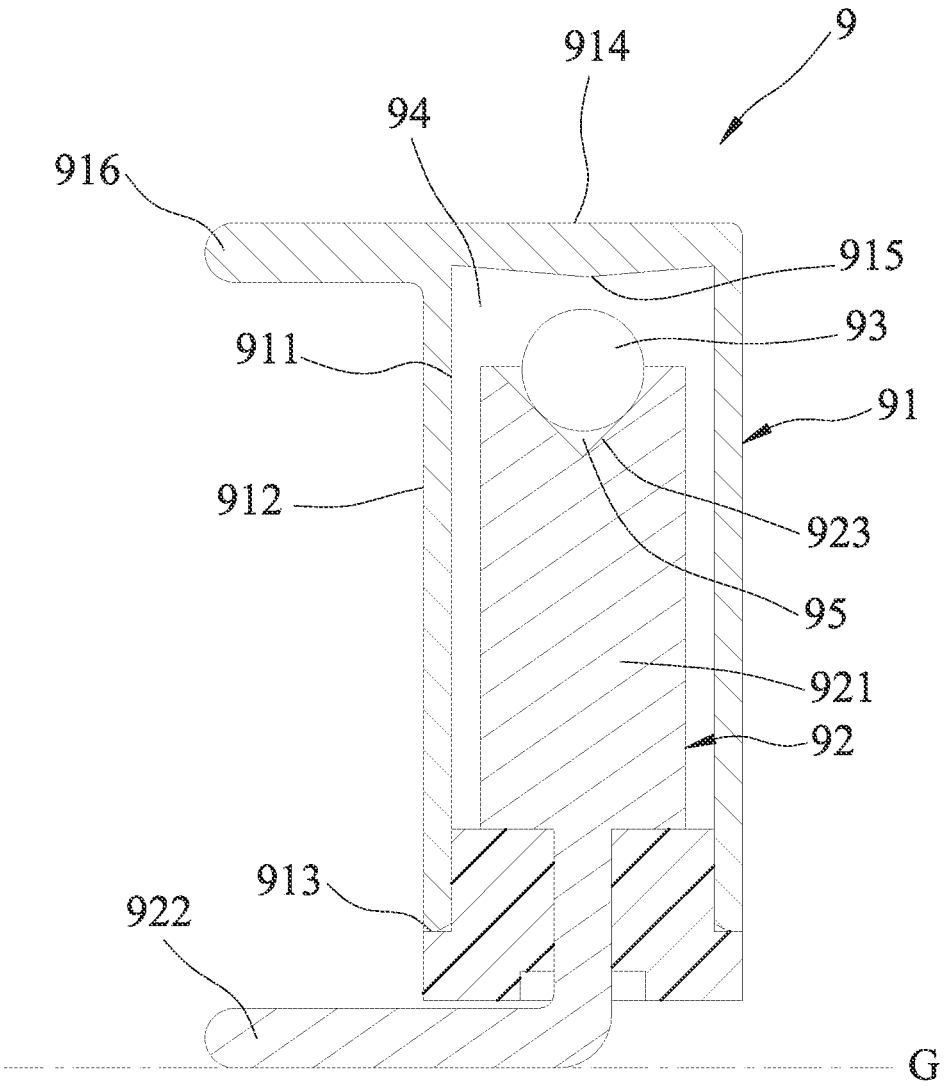
FIG.1 PRIOR ART
FIG. 1 is a sectional view of a conventional tilt ball switch disclosed in Taiwanese Utility Model Patent No. 476445.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
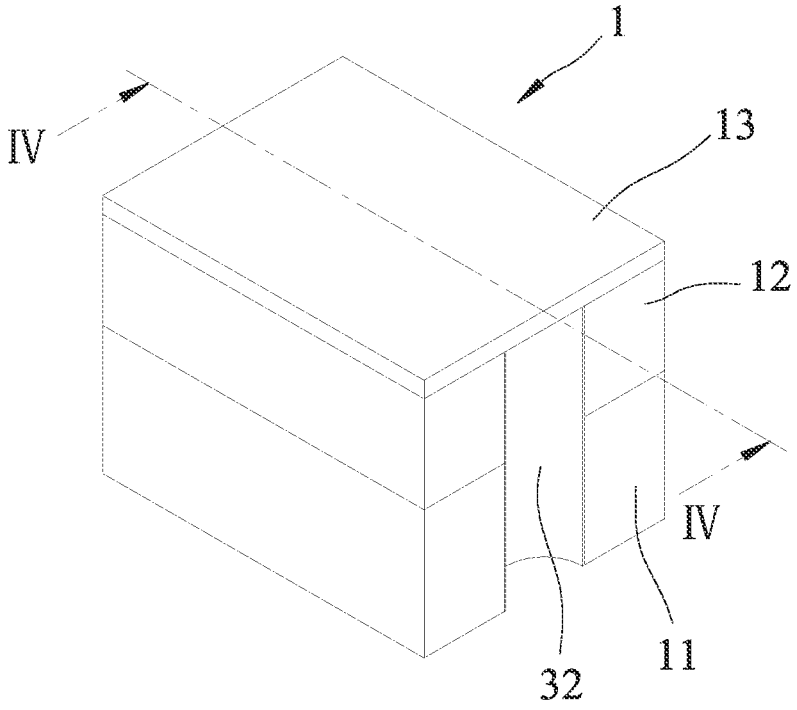
FIG. 2 is a perspective view of a first embodiment of a tilt ball switch according to the disclosure.
Figure 3:
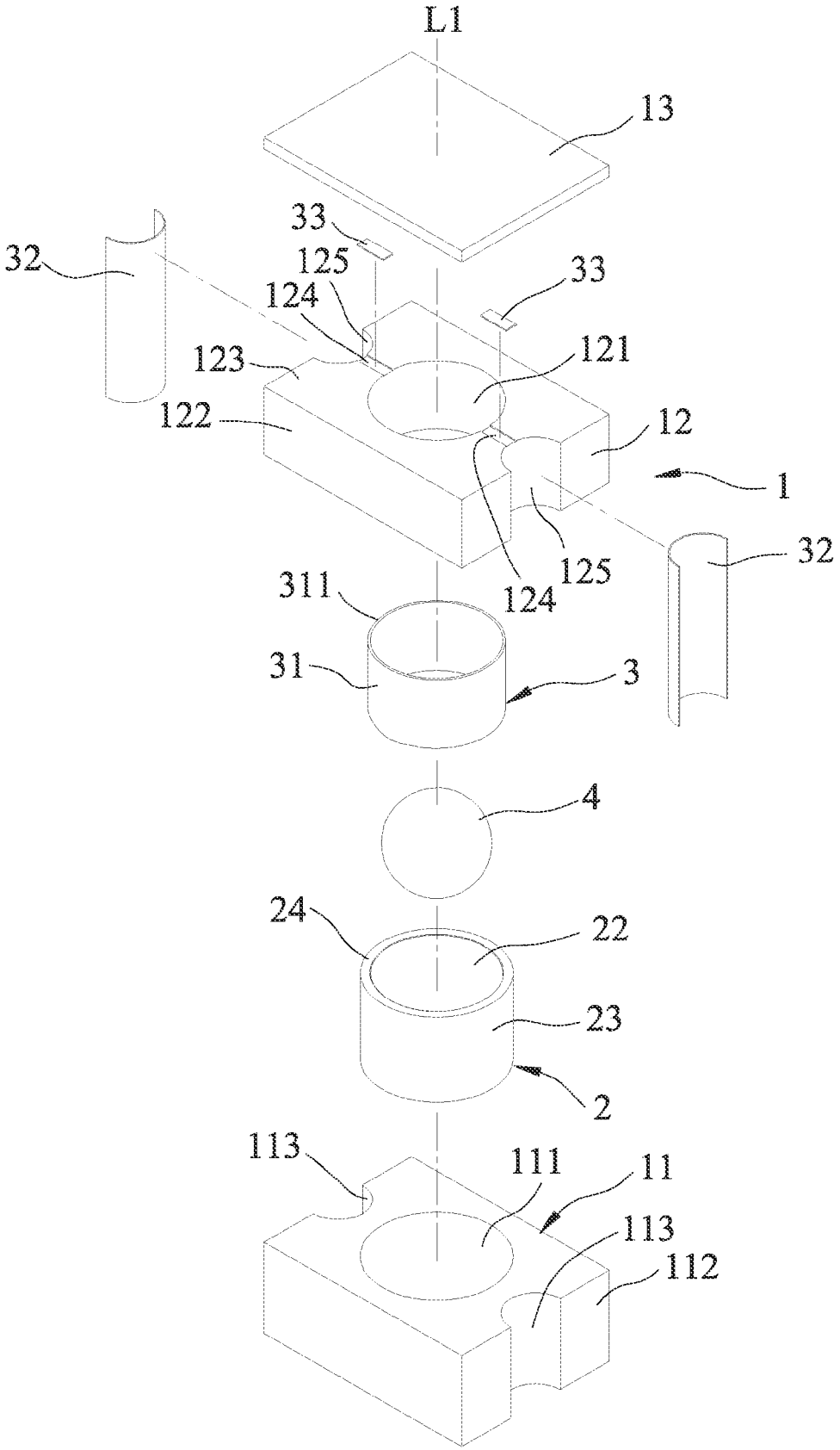
FIG. 3 is an exploded perspective view of the first embodiment.
Figure 4:
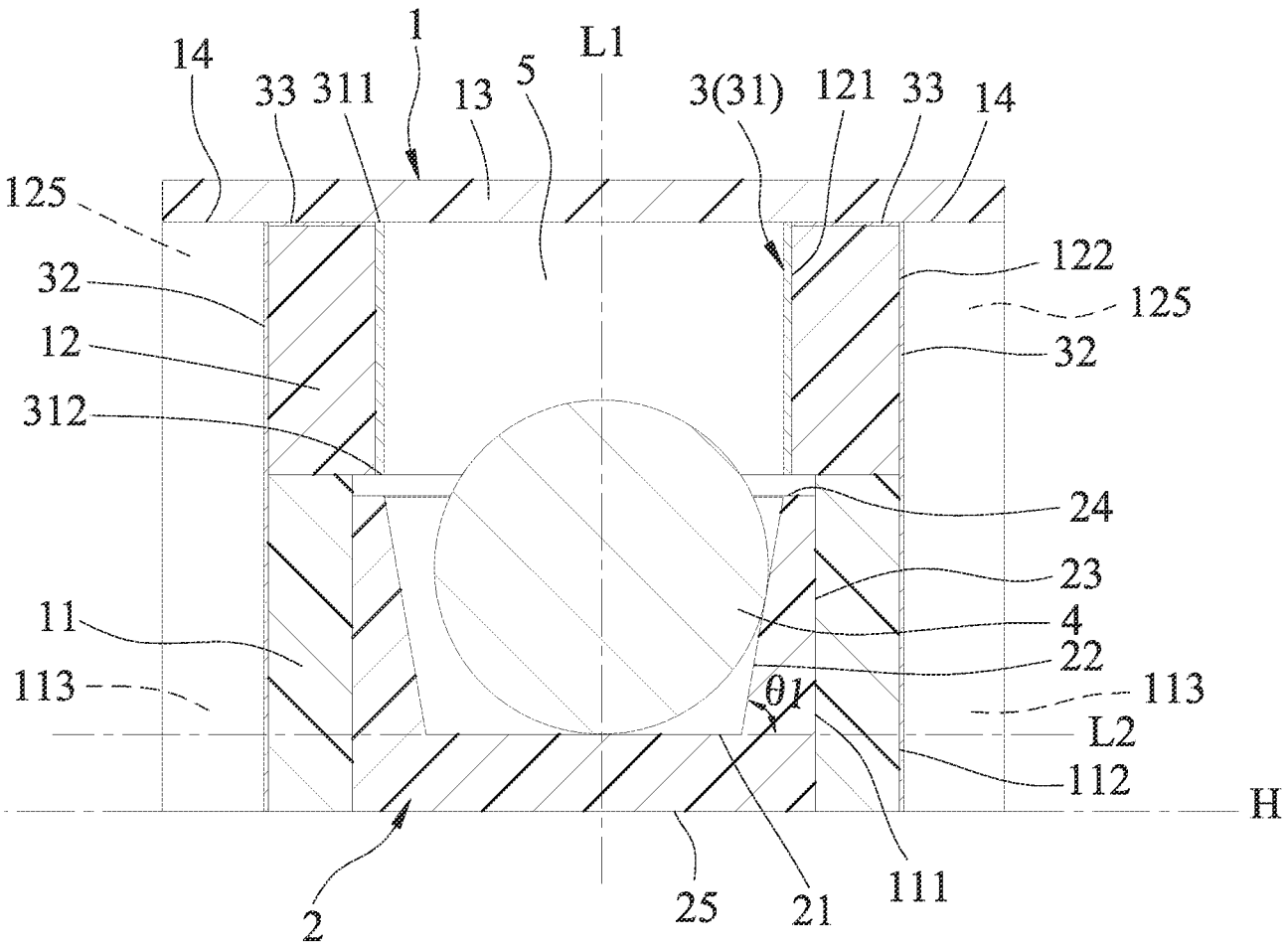
FIG. 4 is a sectional view taken long line IV -IV in FIG. 2 illustrating a conductive ball of the first embodiment in a non-conducting state.

Referring to FIGS. 2 to 4, a first embodiment of a tilt ball switch according to the disclosure includes an insulation housing 1, a first terminal 2, a second terminal 3 and a conductive ball 4.

The insulation housing 1 includes a lower housing wall 11, an upper housing wall 12 and a top wall 13. The lower housing wall 11 surrounds an axis (L1) that extends in an up-down direction. The upper housing wall 12 is located over the lower housing wall 11 and surrounds the axis (L1). The top wall 13 is located over the upper housing wall 12. The axis (L1) extends through the top wall 13.

The lower housing wall 11 has a lower inner wall surface 111 and a lower outer wall surface 112 opposite to the lower inner wall surface 111. Specifically, the lower inner wall surface 111 surrounds the axis (L1), and the lower outer wall surface 112 surrounds the lower inner wall surface 111. The lower outer wall surface 112 has two lower arc surface sections 113 that respectively open in two opposite directions.

The upper housing wall 12 has an upper inner wall surface 121, an upper outer wall surface 122 opposite to the upper inner wall surface 121, an upper connecting surface 123 and two wire slots 124. Specifically, the upper inner wall surface 121 surrounds the axis (L1), and the upper outer wall surface 122 surrounds the upper inner wall surface 121. The upper connecting surface 123 interconnects the upper inner wall surface 121 and the upper outer wall surface 122, and abuts against the top wall 13. The upper outer wall surface 122 has two upper arc surface sections 125 that respectively open in two opposite directions. The wire slots 124 are located at two opposite sides of the axis (L1) in a direction perpendicular to the axis (L1). Each of the wire slots 124 is indented from the upper connecting surface 123 and extends from the upper inner wall surface 121 to a respective one of the upper arc surface sections 125 of the upper outer wall surface 122. The lower housing wall 11, the upper housing wall 12 and the top wall 13 correspond in position to each other. Specifically, the lower arc surface sections 113 of the lower housing wall 11 are respectively aligned with the upper arc surface sections 125 of the upper housing wall 12 in the direction of the axis (L1). In one embodiment, each of the lower arc surface sections 113 has a profile that is the same as that of the respective one of the upper arc surface sections 125. Each of the lower arc surface sections 113 cooperates with the respective one of the upper arc surface sections 125 to define a groove 14 that extends in the up-down direction. The grooves 14 defined by the lower arc surface sections 113 and the upper arc surface sections 125 are respectively located at two opposite sides of the axis (L1) in the direction perpendicular to the axis (L1).

In the first embodiment, each of the lower housing wall 11, the upper housing wall 12 and the top wall 13 is a printed circuit board (PCB). However, in certain modifications of the first embodiment, the lower housing wall 11, the upper housing wall 12 and the top wall 13 may be an insulation component of a different type.

The first terminal 2 is configured to be cup-shaped, is disposed at the lower inner wall surface 111 of the lower housing wall 11, and has a platform surface 21, a frustoconical surface 22, a surrounding surface 23 opposite to the frustoconical surface 22, an open end 24 and a closed end 25 opposite to the open end 24. The platform surface 21 is configured to be in a shape of a circle, and the axis (L1) extends through the platform surface 21. The frustoconical surface 22 surrounds the axis (L1), extends upwardly from the periphery of the platform surface 21, and tapers toward the platform surface 21. The surrounding surface 23 surrounds the frustoconical surface 22 and abuts against the lower inner wall surface 111 of the lower housing wall 11. The open end 24 interconnects the frustoconical surface 22 and the surrounding surface 23. The closed end 25 is connected to the surrounding surface 23. The platform surface 21 is located between the open end 24 and the closed end 25 in the up-down direction and is closer to the closed end 25.

The frustoconical surface 22 of the first terminal 2 cooperates with a base line (L2) (see FIG. 4) orthogonal to the axis (L1) to define an inclination angle (θ1) therebetween. The inclination angle (θ1) ranges from 10 to 85 degrees. In one embodiment, the inclination angle (θ1) ranges from 75 to 85 degrees. In the first embodiment, the inclination angle (θ1) is 80 degrees, and a diameter of the platform surface 21 of the first terminal 2 is larger than a diameter of the conductive ball 4.

The second terminal 3 includes an inner terminal member 31, two outer terminal members 32 and two conductive members 33. The inner terminal member 31 is configured to be tubular, surrounds the axis (L1), and is disposed at the upper inner surface 121 of the upper housing wall 12. Specifically, the inner terminal member 31 abuts against the upper inner surface 121 of the upper housing wall 12. The outer terminal members 32 are spaced apart from each other and are disposed at the upper outer surface 122 of the upper housing wall 12. Each of the conductive members 33 extends from the upper inner wall surface 121 to the upper outer wall surface 122, and separably and conductively interconnects the inner terminal member 31 and a respective one of the outer terminal members 32.

The inner terminal member 31 has an upper end 311 and a lower end 312 opposite to the upper end 311. The upper end 311 surrounds the axis (L1) and abuts against the top wall 13 of the insulation housing 1. The lower end 312 cooperates with the open end 24 of the first terminal 2 to define a gap therebetween. The inner terminal member 31 has an inner diameter larger than the diameter of the conductive ball 4.

Each of the outer terminal members 32 of the second terminal 3 is configured to be in a shape of a curved plate, and is disposed at a respective one of the grooves 14 defined by the lower arc surface sections 113 of the lower housing wall 11 and the upper arc surface sections 125 of the upper housing wall 12. In one embodiment, each of the outer terminal members 32 has a profile that is the same as those of the respective one of the lower arc surface sections 113 and the respective one of the upper arc surface sections 125. Each of the conductive members 33 is disposed at and extends through a respective one of the wire slots 124 of the upper housing wall 12.

In the first embodiment, the conductive members 33 are made of a copper foil material that is used in printed circuit boards.

The lower housing wall 11 of the insulation housing 1 cooperates with the upper housing wall 12 of the insulation housing 1, the top wall 13 of the insulation housing 1, the first terminal 2 and the inner terminal member 31 of the second terminal 3 to define a chamber space 5.

Figure 5:
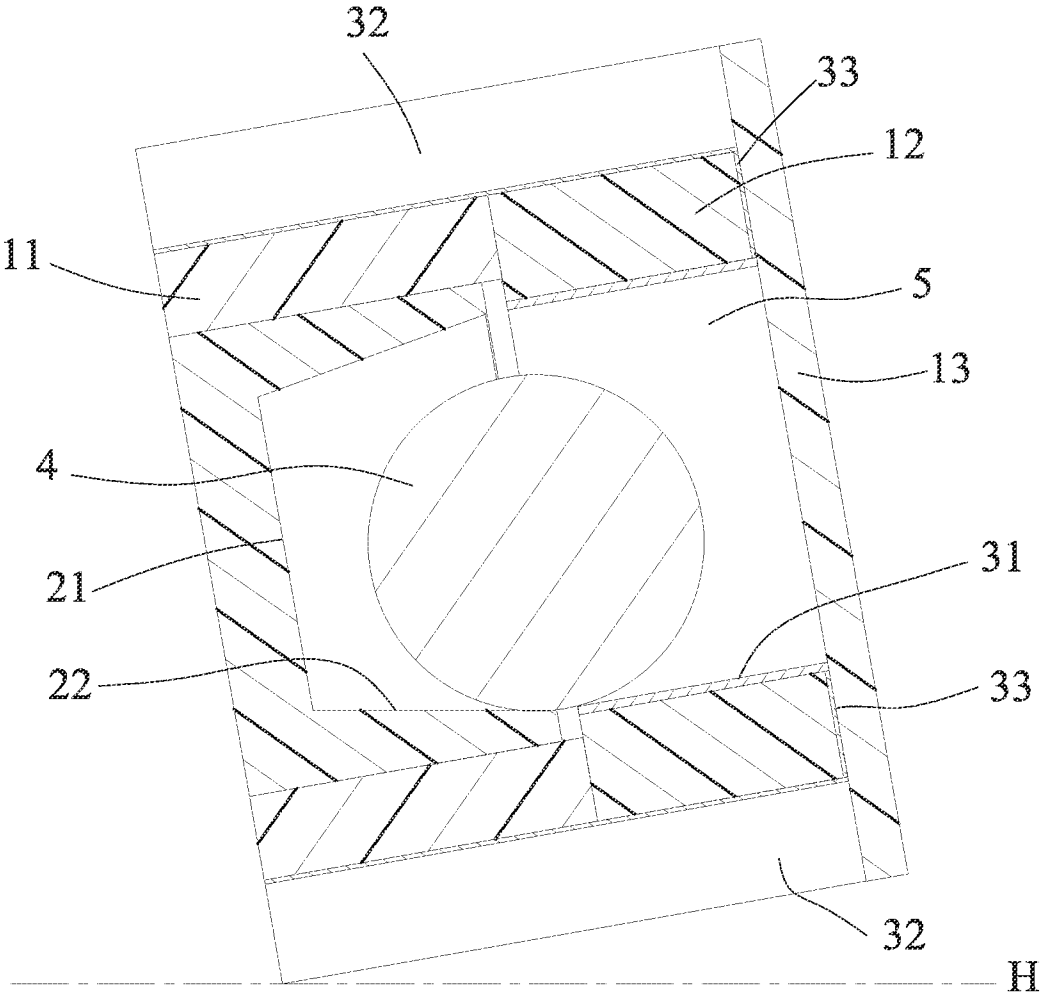
FIG. 5 is a sectional view similar to FIG. 4, but with the first embodiment tilted at an angle of 80 degrees relative to a reference horizontal plane so as to urge the conductive ball to convert to a conducting state.
Figure 6:
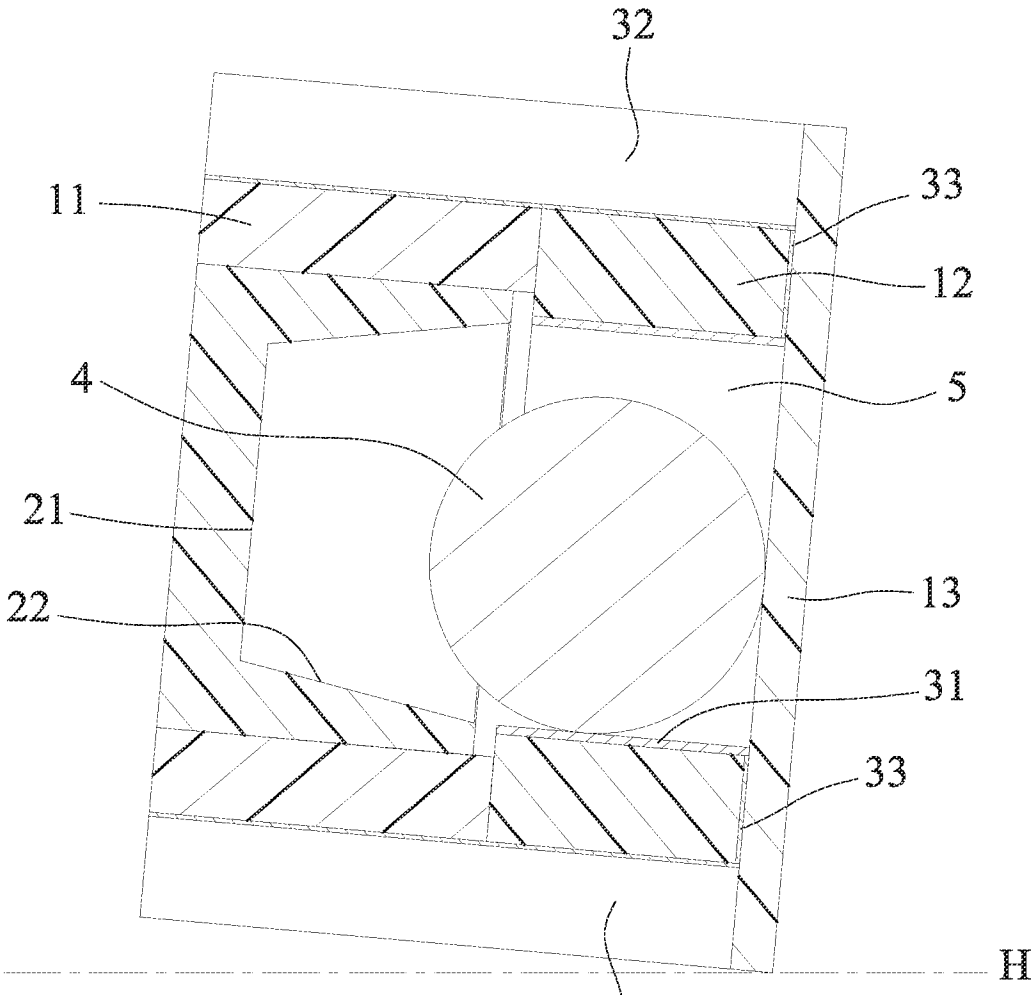
FIG. 6 is a sectional view similar to FIG. 5, but with the first embodiment tilted at an angle greater than 90 degrees relative to the reference horizontal plane so as to urge the conductive ball to convert to the non-conducting state.

The conductive ball 4 is movably disposed in the chamber space 5 and is convertible between a conducting state (see FIG. 5), in which the conductive ball 4 is in contact with both of the frustoconical surface 22 of the first terminal 2 and the inner terminal member 31 of the second terminal 3 so that the first terminal 2 is conductively connected to the outer terminal members 32 of the second terminal 3, and a non-conducting state (see FIGS. 4 and 6), in which the conductive ball 4 is prevented from being in contact with one of the frustoconical surface 22 of the first terminal 2 and the inner terminal member 31 so that the first terminal 2 is prevented from being conductively connected to the outer terminal members 32.

Specifically, when the tilt ball switch is placed in a manner that the axis (L1) is perpendicular to a reference horizontal plane (H) (i.e., the tilt ball switch is not tilted), the conductive ball 4 is in contact with the platform surface 21 and the frustoconical surface 22 of the first terminal 2, and is not in contact with the inner terminal member 31 of the second terminal 3 (i.e., the conductive ball 4 is in the non-conducting state). At this time, by virtue of the gap that is defined by the lower end 312 of the inner terminal member 31 and the open end 24 of the first terminal 2, the first terminal 2 is prevented from being conductively connected to the outer terminal members 32 through the inner terminal member 31. It is noted that, in certain situations when the tilt ball switch is not tilted, the conductive ball 4 may only be in contact with the platform surface 21.

When the tilt ball switch is tilted at an angle greater than 80 degrees with respect to the reference horizontal plane (H) (see FIG. 5), the conductive ball 4 rolls away from the platform surface 21 of the first terminal 2 so as to be in contact with both the frustoconical surface 22 of the first terminal 2 and the inner terminal member 31 of the second terminal 3. When the conductive ball 4 is in contact with the frustoconical surface 22 and the inner terminal member 31, the conductive ball 4 is in the conducting state, and the first terminal 2 is conductively connected to the outer terminal members 32 of the second terminal 3 through the conductive ball 4, the inner terminal member 31 and the conductive members 33 of the second terminal 3.

When the tilt ball switch is tilted at an angle greater than 90 degrees with respect to the reference horizontal plane (H) (see FIG. 6), the conductive ball 4 rolls away from the frustoconical surface 22 of the first terminal 2 and rolls toward the top wall 13 of the insulation housing 1. At this time, the conductive ball 4 is in contact with the inner terminal member 31 and separated from the frustoconical surface 22, and is converted into the non-conducting state. Consequently, the first terminal 2 is prevented from being conductively connected to the outer terminal members 32.

According to the abovementioned description, benefits of this embodiment can be analyzed and listed as below:

a) When the tilt ball switch is tilted at an angle greater than 80 degrees and less than 90 degrees, the conductive ball 4 is in contact with the frustoconical surface 22 of the first terminal 2 and the inner terminal member 31 of the second terminal 3 and is in the conducting state. Then, if the tilt ball switch is rotated in a first direction so as to be tilted at an angle smaller than 80 degrees, the conductive ball 4 recedes and rolls away from the inner terminal member 31 toward the platform surface 21 of the first terminal 2 so that the conductive ball 4 is not in contact with the inner terminal member 31. If the tilt ball switch is rotated in a second direction opposite to the first direction so as to be tilted at an angle greater than 90 degrees, the conductive ball 4 recedes and rolls away from the frustoconical surface 22 of the first terminal 2 toward the top wall 13 of the insulation housing 1 so that the conductive ball 4 is not in contact with the frustoconical surface 22. By virtue of the inclination angle (θ) defined by the frustoconical surface 22 and the base line (L2), the conductive ball 4 is able to be converted into the conducting state when the tilt ball switch is tilted at an angle within a predetermined range. Moreover, by virtue of the frustoconical surface 22, the conductive ball 4 may roll smoothly when converting between the conducting state and the non-conducting state. In other words, the tilt ball switch is able to react swiftly when tilted, and the conductive ball 4 may not be easily stuck in the gap between the lower end 312 of the inner terminal member 31 and the open end 24 of the first terminal 2.

b) By virtue of the outer terminal members 32 of the second terminal 3 being respectively disposed at the grooves 14 that are located at the opposite sides of the axis (L1), the tilt ball switch may be suitable for a wide variety of applications.

Figure 7:
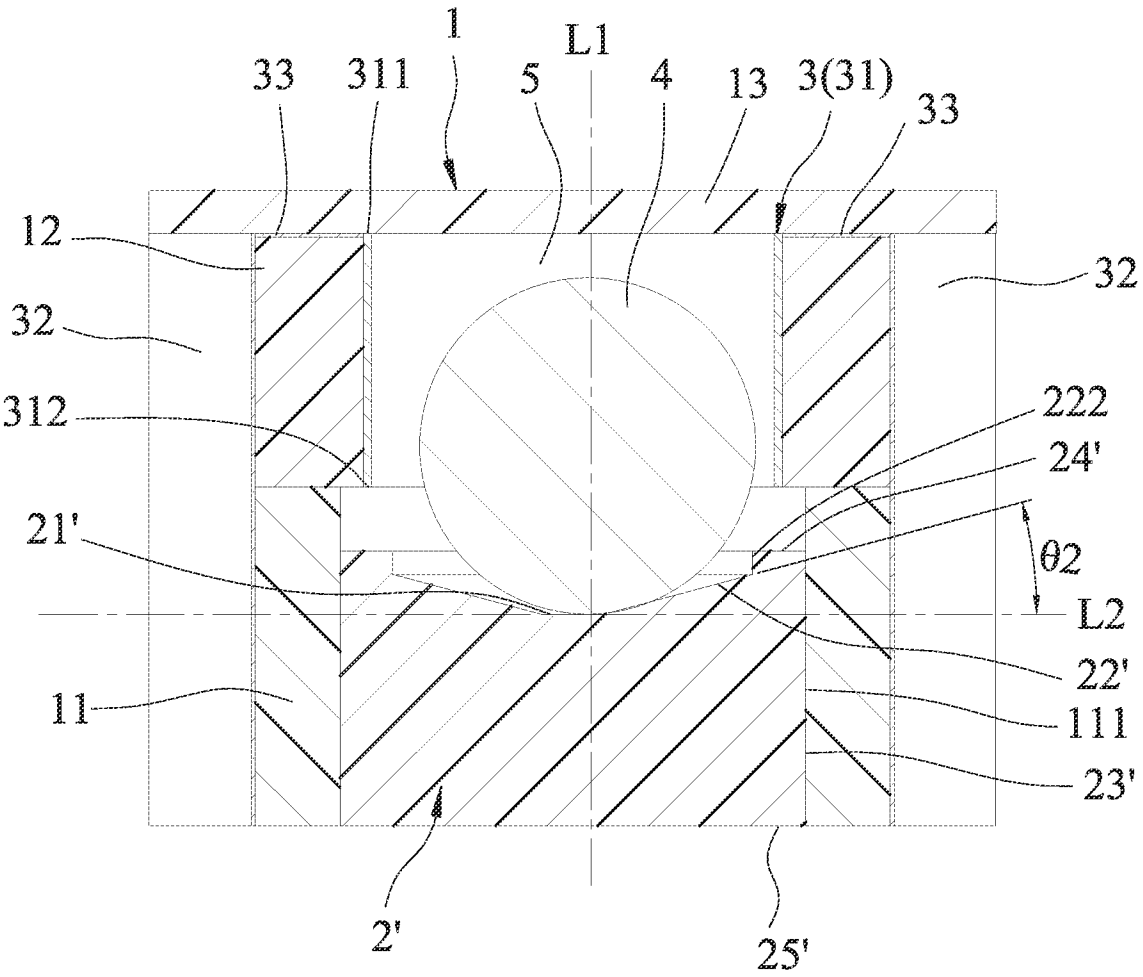
FIG. 7 is a sectional view of a second embodiment of the tilt ball switch illustrating the conductive ball of the second embodiment in the non-conducting state.
Figure 8:
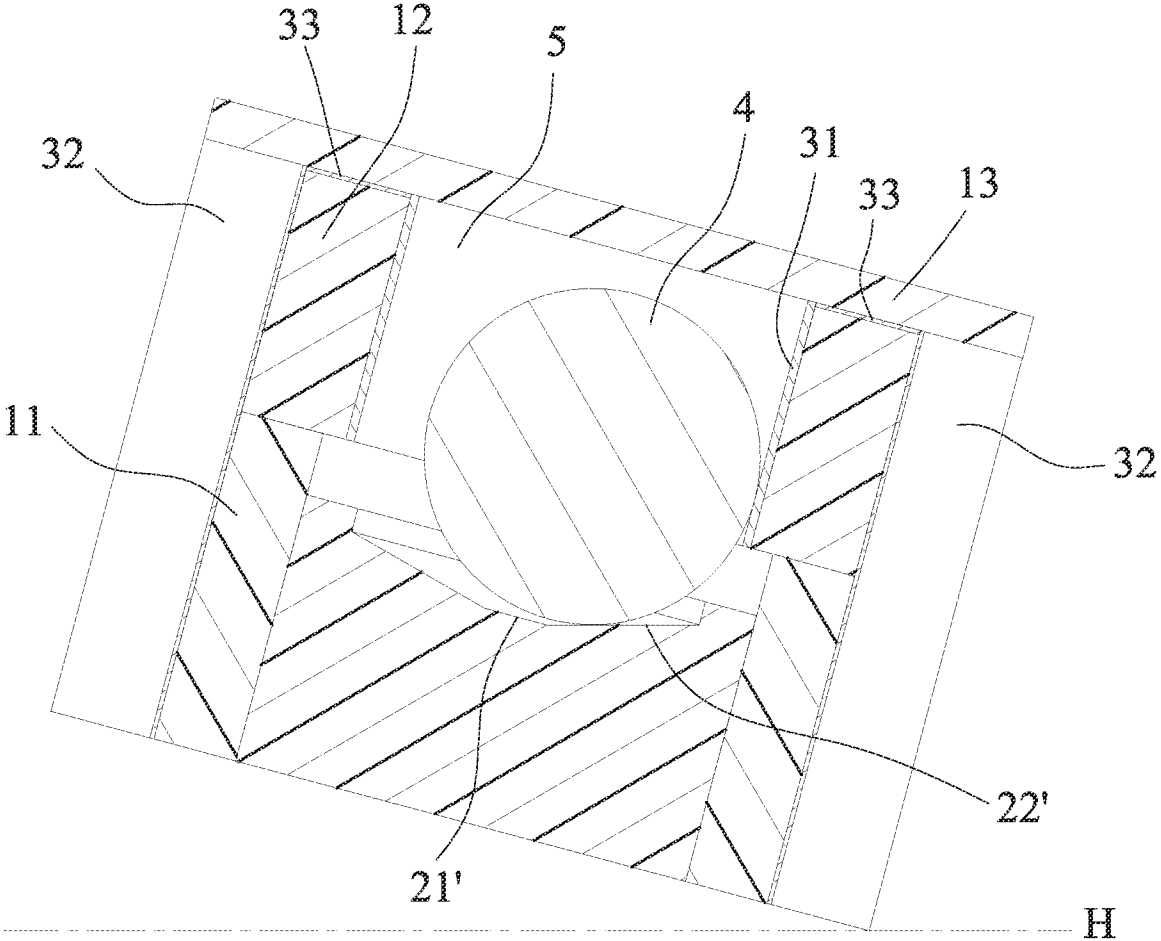
FIG. 8 is a sectional view similar to FIG. 7, but with the second embodiment tilted at an angle of 15 degrees relative to the reference horizontal plane so as to urge the conductive ball to convert to the conducting state.
Figure 9:
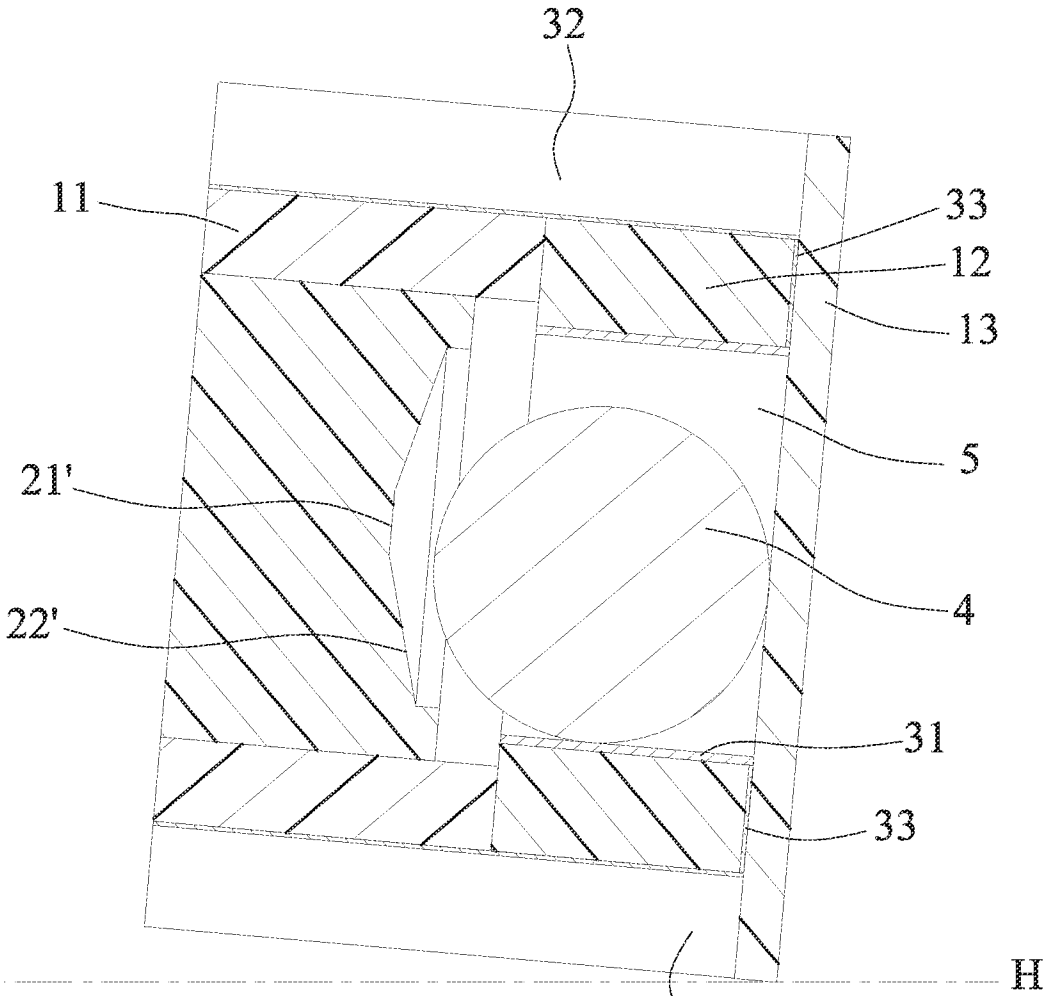
FIG. 9 is a sectional view similar to FIG. 8, but with the second embodiment tilted at an angle greater than 90 degrees relative to the reference horizontal plane so as to urge the conductive ball to convert to the non-conducting state.

Referring further to FIGS. 7 to 9, a second embodiment of the tilt ball switch according to the disclosure includes the insulation housing 1, the second terminal 3, the conductive ball 4 and a different configuration of the first terminal 2'. In the second embodiment, the first terminal 2' is configured to be cup-shaped, is disposed at the lower inner wall surface 111 of the lower housing wall 11, and has the platform surface 21', the frustoconical surface 22', the surrounding surface 23' opposite to the frustoconical surface 22', the open end 24', and the closed end 25' opposite to the open end 24'. The platform surface 21' is configured to be in a shape of a circle, and the axis (L1) extends through the platform surface 21'. The frustoconical surface 22' surrounds the axis (L1), extends upwardly from the periphery of the platform surface 21', and tapers toward the platform surface 21'. The surrounding surface 23' surrounds the frustoconical surface 22' and abuts against the lower inner wall surface 111 of the lower housing wall 11. The closed end 25' is connected to the surrounding surface 23'.

In this embodiment, the first terminal 2' further has a cylindrical surface 222 that extends upwardly from an upper periphery of the frustoconical surface 22' in the extending direction of the axis (L1). The open end 24' interconnects the cylindrical surface 222 and the surrounding surface 23'.

The frustoconical surface 22' cooperates with the base line (L2) (see FIG. 7) to define an inclination angle (θ2) therebetween. The inclination angle (θ2) ranges from 10 to 20 degrees. In the second embodiment, the inclination angle (θ2) is 15 degrees. The platform surface 21' is located between the open end 24' and the closed end 25' in the up-down direction and is closer to the open end 24'. A diameter of the platform surface 21' is smaller than the diameter of the conductive ball 4.

When the second embodiment of the tilt ball switch is tilted at an angle greater than 15 degrees and less than 90 degrees with respect to the reference horizontal plane (H), the conductive ball 4 is in contact with both the frustoconical surface 22' of the first terminal 2' and the inner terminal member 31 of the second terminal 3 and is in the conducting state (see FIG. 8). The first terminal 2' is conductively connected to the outer terminal members 32 of the second terminal 3 through the conductive ball 4, the inner terminal member 31 and the conductive members 33 of the second terminal 3. Then, when the tilt ball switch is rotated in the second direction so as to be tilted at an angle greater than 90 degrees, the conductive ball 4 recedes and rolls away from the frustoconical surface 22' toward the top wall 13 of the insulation housing 1 so that the conductive ball 4 is not in contact with the frustoconical surface 22'. At this time, the conductive ball 4 is converted into the non-conducting state (see FIG. 9). Consequently, the first terminal 2' is not conductively connected to the inner terminal member 31 and the first terminal 2' is prevented from being conductively connected to the outer terminal members 32.

Because the conductive ball 4 is able to be converted into the conducting state when the second embodiment of the tilt ball switch is tilted at an angle within a predetermined range (i.e., between 15 and 90 degrees in the second embodiment), the second embodiment has the same functionality and achieves the same results as the first embodiment.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A tilt ball switch comprising:

an insulation housing including a lower housing wall that has a lower inner wall surface surrounding an axis that extends in an up-down direction, and a lower outer wall surface surrounding said lower inner wall surface, an upper housing wall that is located over said lower housing wall and that has an upper inner wall surface surrounding the axis, and an upper outer wall surface surrounding said upper inner wall surface, and a top wall through which the axis extends, said top wall being located over said upper housing wall;

a first terminal disposed at said lower inner wall surface of said lower housing wall and having a platform surface through which the axis extends, and a frustoconical surface that surrounds the axis, that extends upwardly from said platform surface, and that cooperates with a base line orthogonal to the axis to define an inclination angle therebetween, said inclination angle ranging from 10 to 85 degrees, said frustoconical surface tapering toward said platform surface;

a second terminal including an inner terminal member that surrounds the axis and that is disposed at said upper inner surface of said upper housing wall, two outer terminal members that are spaced apart from each other and that are disposed at said upper outer surface of said upper housing wall, and two conductive members each of which extends from said upper inner wall surface to said upper outer wall surface, and conductively interconnects said inner terminal member and a respective one of said outer terminal members, said lower housing wall cooperating with said upper housing wall, said top wall, said first terminal and said inner terminal member of said second terminal to define a chamber space; and a conductive ball movably disposed in said chamber space and convertible between a conducting state, in which said conductive ball is in contact with said frustoconical surface of said first terminal and said inner terminal member of said second terminal so that said first terminal is conductively connected to said outer terminal members of said second terminal, and a non-conducting state, in which said conductive ball is prevented from being in contact with one of said frustoconical surface of said first terminal and said inner terminal member so that said first terminal is prevented from being conductively connected to said outer terminal members.

2. The tilt ball switch as claimed in claim 1, wherein said inner terminal member of said second terminal is configured to be tubular, surrounds the axis, and has an inner diameter larger than a diameter of said conductive ball.

3. The tilt ball switch as claimed in claim 2, wherein said platform surface of said first terminal is configured to be in a shape of a circle whose diameter is larger than the diameter of said conductive ball.

4. The tilt ball switch as claimed in claim 3, wherein said inclination angle ranges from 75 to 85 degrees.

5. The tilt ball switch as claimed in claim 2, wherein said platform surface of said first terminal is configured to be in a shape of a circle whose diameter is smaller than the diameter of said conductive ball.

6. The tilt ball switch as claimed in claim 5, wherein said inclination angle ranges from 10 to 20 degrees.

7. The tilt ball switch as claimed in claim 1, wherein:

said lower outer wall surface of said lower housing wall has two lower arc surface sections that respectively open in two opposite directions;

said upper outer wall surface of said upper housing wall has two upper arc surface sections that respectively open in two opposite directions;

each of said lower arc surface sections cooperates with a respective one of said upper arc surface sections to define a groove that extends in the up-down direction; and each of said outer terminal members of said second terminal is configured to be in a shape of a curved plate and is disposed at a respective one of said grooves defined by said lower arc surface sections and said upper arc surface sections.

* * * * *